US005461889A

United States Patent [19]

Adams et al.

[11] Patent Number: 5,461,889

[45] Date of Patent: Oct. 31, 1995

[54] PLASTIC SPACER RING HAVING AN ANNULAR GROOVE FOR SEALING PLASTIC DYE TUBES

[75] Inventors: Samuel F. Adams; Hans-Peter Bolz, both of Greenville, S.C.

[73] Assignee: Sonoco Products Company, Hartsville, S.C.

[21] Appl. No.: 116,053

[22] Filed: Sep. 2, 1993

[51] Int. Cl.[6] ..... D06B 23/04

[52] U.S. Cl. ..... 68/189; 68/198; 68/212; 242/118.1

[58] Field of Search ..... 68/189, 198, 212; 242/118.1, 118.2, 118.32

[56] References Cited

U.S. PATENT DOCUMENTS

| | | | |
|---|---|---|---|
| 1,730,320 | 10/1929 | Dunlap | 68/189 |
| 1,871,246 | 8/1932 | Thus | 68/198 |
| 1,928,251 | 9/1933 | Gollong . | |
| 1,928,252 | 9/1933 | Gollong . | |
| 1,939,817 | 12/1933 | Hornbuckle et al. . | |
| 2,089,962 | 8/1937 | Huttinger . | |
| 2,679,153 | 5/1954 | Annicq | 68/198 |
| 2,694,913 | 11/1954 | Annicq | 68/198 |
| 3,086,381 | 4/1963 | Jackson . | |
| 3,097,515 | 7/1963 | Claiborne | 68/198 |
| 3,253,436 | 5/1966 | Soltis . | |
| 3,425,149 | 2/1969 | Fletcher | 242/118.32 |
| 3,433,432 | 3/1969 | Willis . | |
| 3,759,460 | 9/1973 | Fyans | 68/198 |
| 3,882,698 | 5/1975 | Livingstone | 68/198 |
| 4,665,722 | 5/1987 | Ashley et al. . | |
| 4,914,359 | 4/1990 | Powel et al. | 242/118.32 |

FOREIGN PATENT DOCUMENTS

| | | | |
|---|---|---|---|
| 1239001 | 7/1960 | France | 68/198 |
| 1083214 | 6/1960 | Germany | 68/198 |

*Primary Examiner*—Frankie L. Stinson
*Attorney, Agent, or Firm*—Bell, Seltzer, Park & Gibson

[57] ABSTRACT

A plastic spacer ring for spacing apart and sealing plastic dye tubes during yarn package dyeing. Each plastic spacer ring has an annular groove on both its upper and lower surface for receiving an end face of a dye tube. Each groove has an open top and a closed bottom with the width of the open top greater than, and the width at the closed bottom less than the predetermined wall thickness of the plastic dye tube body. This construction provides tangential contact between the end faces of the plastic dye tubes on both side walls of the annular groove, which in turn, provides two seals substantially continuously about the circumference of the end face of the dye tube.

19 Claims, 1 Drawing Sheet

PLASTIC SPACER RING HAVING AN ANNULAR GROOVE FOR SEALING PLASTIC DYE TUBES

FIELD OF THE INVENTION

The invention relates to a spacer ring for the spacing and sealing of dye tubes during package dyeing of yarns. More specifically, the invention is directed to a plastic spacer ring having an annular groove for receiving and sealing an end face of a plastic dye tube body.

BACKGROUND OF THE INVENTION

In a package dyeing operation, yarn is wound onto special tubes or cores and the resulting yarn package is dyed as a unit. The tubes or cores are generally tubular and include a plurality of holes through the bodywall to allow dye to flow from the interior of the dye tube radially outward through the yarn wound about the tube.

The package dyeing operation involves mounting a number of yarn packages upon a generally tubular spindle of the package dyeing apparatus. The packages are mounted on the spindle so that the spindle extends substantially coaxially through the dye tube of each yarn package. The spindle also has a number of holes to allow dye to pass from its interior outwardly to the yarn packages. A first end of the spindle is rotatably affixed to a base while the second end of the spindle is covered by a cap. The yarn packages placed on the spindle are axially compressed between the cap and the base.

In operation, dye is forced under pressure from a dye source or reservoir through the spindle. The dye is subsequently forced through the holes of both the spindle and the dye tubes, thus, permeating and dyeing the yarn wound upon the dye tubes. In order to maintain consistent dyeing of the yarn, a substantially equal amount of dye under substantially equal pressure must be presented to each yarn package.

The maintenance of substantially equal dye pressures for each package is accomplished, in part, by the use of spacer rings. The spacer rings are coaxially mounted on the spindle between adjacent yarn packages and function both to space the yarn packages apart and to seal the end faces of the yarn packages. In order to prevent dye leaks between adjacent packages and a resulting loss of dye pressure, the spacer rings must reliably seal each end face of the dye tubes.

In the past, dye tubes as well as spacer rings were typically formed of metallic materials. The walls of the metallic dye tubes are generally relatively thin, such as 1.2 mm to 1.8 mm, due to the strength of the metal. Metallic spacer rings typically have a center cylindrical portion and frustoconical shaped peripheral edges that taper from a relatively large axial thickness adjacent the center cylindrical portion to a relatively small axial thickness at the periphery. The diameter of the cylindrical portion of the ring is less than the inside diameter of the dye tube although the overall diameter of the spacer ring is larger than the inside diameter of the dye tube.

In use, the central cylindrical faces of the spacer rings are inserted into the open ends of adjacent dye tubes. The end face of each dye tube is thereby seated on the tapered sidewall of a spacer ring. The spacer ring thus axially aligns and seals adjacent dye tubes by tangentially contacting the interior surface of the end face of the dye tube substantially continuously about the circumference of the end face.

Due to the relatively high strength of the metallic spacer rings and dye tubes, the yarn packages can be placed under substantial axial pressure in order to improve the seal between the spacer rings and the dye tubes without structurally damaging them. This increased axial pressure also causes slight inward bowing of the tapered sidewall of the spacer ring. The bowing of the sidewalls further improves the seal since tangential contact is established over a broader surface area of the end face of the dye tube and the tapered sidewall of the spacer ring.

More recently, dye tubes have been formed of plastic materials. Although yarn packages having plastic dye tubes must also be properly sealed in order to dye the yarn consistently, plastic dye tubes cannot withstand as much axial pressure as metallic dye tubes without being structurally damaged. Accordingly plastic dye tubes which are mounted upon a spindle are more likely than metal tubes to suffer damage. However decreasing the axial compression applied to the tubes in order protect them can inhibit effective sealing between the plastic dye tubes and the spacer rings.

SUMMARY OF THE INVENTION

The invention provides a spacer ring for spacing and sealing adjacent plastic dye tubes in a package dyeing apparatus that can significantly reduce or eliminate dye leakage during yarn package dyeing without substantial harm to the dye tubes. The spacer ring of the invention comprises an annular body formed of a plastic material and includes opposed upper and lower surfaces with each of the surfaces having an annular groove for receiving an end face of a plastic dye tube body. Each groove is of a diameter substantially the same as the diameter as the plastic tube body. Each of the grooves is defined in transverse cross-section by opposed side walls defining an open top and a closed bottom with the width at the top of each groove being greater than the wall thickness of the plastic dye tube body. The width of the bottom of each of the grooves is less than the wall thickness of the plastic dye tube. Accordingly when the end face of the plastic dye tube is seated in the annular groove, the two opposed walls of the annular groove tangentially contact both an interior surface and an exterior surface of the end face of the plastic dye tube body substantially continuously about the circumference of the plastic dye tube body. This provides double contacting surfaces for forming a double seal between the spacer ring and the dye tube body and can substantially improve the sealing function of the spacer ring. Because the spacer ring is formed of plastic, there is less likelihood of damage to the dye tube.

The sealing ring of the invention are preferably adapted for use with standard dye tube bodies that have a standard predetermined wall thickness and diameter. Typically, the predetermined wall thickness of the plastic dye tube body is within the range of 3.2 mm to 3.8 mm. Accordingly, the width across the top of each the grooves of the preferred spacer rings of the invention is substantially greater than about 3.8 mm and the width at the bottom of each of the grooves is preferably less than about 3.2 mm. Typically, the predetermined diameter of the plastic tube body is between about 43.0 mm and about 65.6 mm from center to center of the wall of the tube body and, thus, the diameter of the centerlines of the annular grooves in the preferred spacer ring of the invention is also between about 43.0 mm and about 65.6 mm. In addition, the predetermined diameter defined by the exterior of the walls of the plastic tube body is between about 44.7 mm and about 67.5 mm. Preferably, each of the grooves of the plastic spacer ring is preferably substantially concentric with respect to a bore of the plastic spacer ring to facilitate spacing and aligning of the plastic dye tube body with the spindle of package dyeing apparatus.

Preferably, the plastic spacer ring is formed of a plastic material that is both structurally and chemically stable to dye at elevated temperatures. In one advantageous embodiment, the plastic spacer ring is formed of a composite plastic material comprising polybutylene terephthalate and fibers of glass. In another advantageous embodiment, the plastic spacer ring is formed of nylon. Preferably, the plastic spacer ring and the plastic dye tube body are formed of materials which react in the same manner to the dyeing, scouring and drying cycles. To insure that the plastic spacer ring and the plastic dye tube body react in the same way to the dyeing, scouring and drying processing cycles, the plastic spacer ring and the plastic dye tube body may be formed of the same plastic material.

In one preferred embodiment, each of the sidewalls of each annular groove is concave in transverse cross-section. In another preferred embodiment, each of the grooves is substantially V-shaped in transverse cross-section. In either embodiment, however, the annular groove of the plastic spacer ring provides improved sealing with an end face of a plastic dye tube due to tangential contact along both an interior surface and an exterior surface of the end face of the plastic dye tube substantially continuously about the circumference of the plastic dye tube body.

BRIEF DESCRIPTION OF THE DRAWINGS

In the drawings which form a portion of the original disclosure of the invention.

DETAILED DESCRIPTION OF THE PREFERRED EMBODIMENT

In the following detailed description, exemplary-preferred embodiments of the invention are described to enable practice of the invention. It will be apparent that the terms used in describing the invention are used for the purpose of description and not for the purpose of limiting the invention to the preferred embodiment. It will also be apparent that the invention is susceptible to numerous variations and modifications as will become apparent from the consideration of the invention as shown in the attached drawings described herein.

Figure 1:
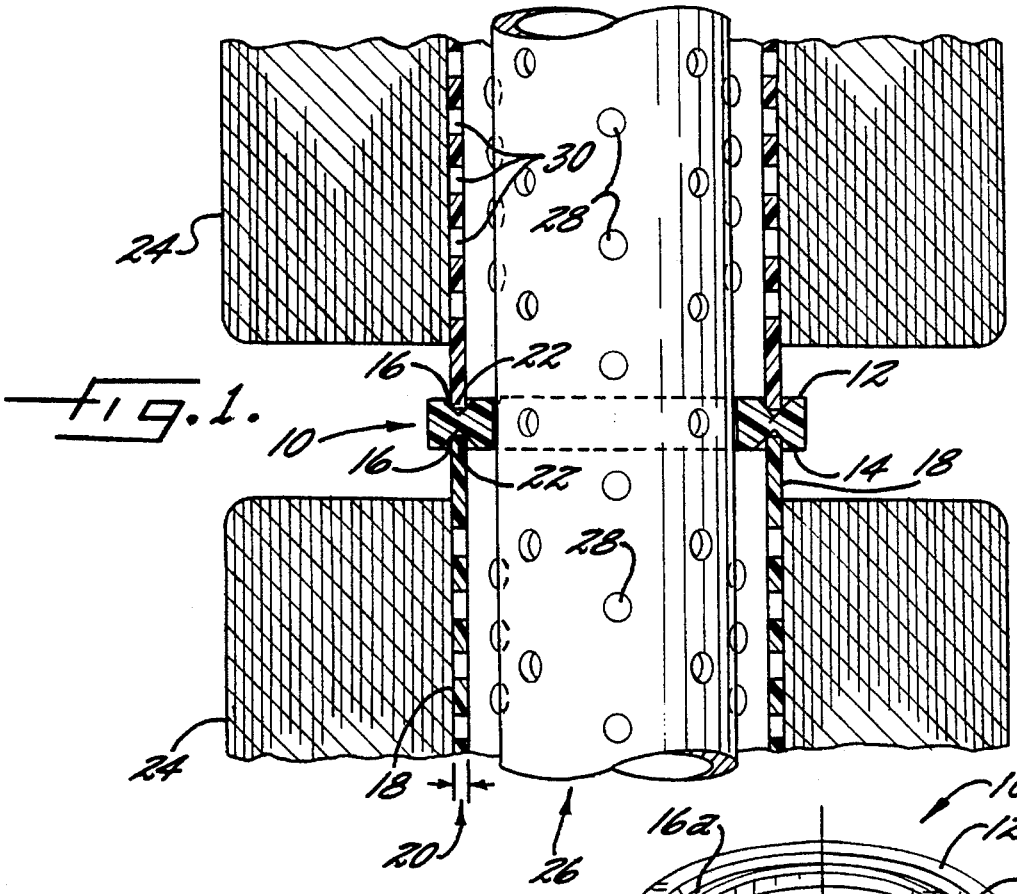
FIG. 1 is a cross-sectional view of one preferred embodiment of the present invention showing a plastic spacer ring having opposed upper and lower annular grooves each of which is in contact with an end face of a plastic dye tube.
Figure 2:
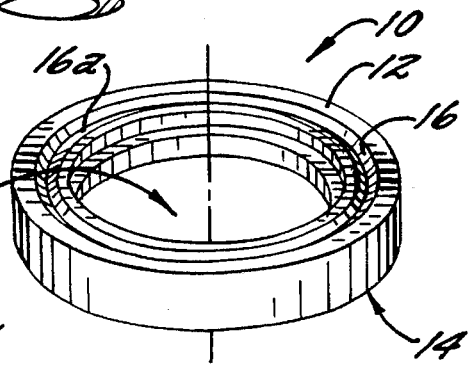
FIG. 2 is a perspective view of a preferred plastic spacer ring of the present invention.

FIG. 1 illustrates one preferred construction of the plastic spacer ring 10 of the present invention. As illustrated in FIGS. 1 and 2, the plastic spacer ring 10 has opposed upper and lower surfaces 12, 14, with each surface having an annular groove 16. As shown in FIG. 1, the plastic spacer ring 10 is adapted for use with a plastic dye tube 18 having a generally tubular plastic dye tube body with a predetermined wall thickness 20 and opposed end faces 22.

Yarn 24 is wound upon the plastic dye tube 18 to form a yarn package. A number of yarn packages are mounted upon a spindle 26 such that the spindle 26 extends substantially coaxially through each of the plastic dye tubes 18 of the yarn packages. Plastic spacer rings 10 are positioned between each yarn package such that the annular groove 16 of the plastic spacer ring 10 receives an end face 22 of the plastic dye tube body 18 as shown in FIG. 1.

As is known in the art, a first end of the spindle 26 is affixed to a base (not shown) and an end cap (also not shown) is preferably mounted on the second end of the spindle 26 to axially compress each yarn package. In the present invention, however, the amount of compression is controlled such that the plastic dye tubes and plastic spacer rings are not structurally damaged. Dye is thereinafter circulated, typically by a pump means, through the interior of the spindle 26. Both the spindle 26 and the plastic dye tubes 18 have a plurality of ports 28, 30, respectively through which the dye is forced. Since the plastic spacer rings 10 form a seal about the end faces 22 of the plastic dye tubes 18, substantially all of the dye is forced through the yarn 24 wound upon the plastic dye tubes 18, thus, dyeing each of the yarn packages consistently.

Figure 3:
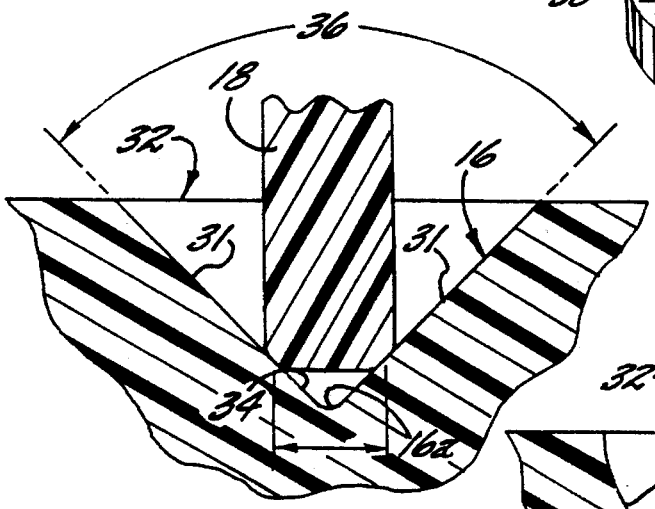
FIG. 3 is a fragmentary cross-sectional view of an annular groove of a plastic spacer ring of the present invention illustrating an annular groove which is substantially V-shaped in transverse cross-section.
Figure 4:
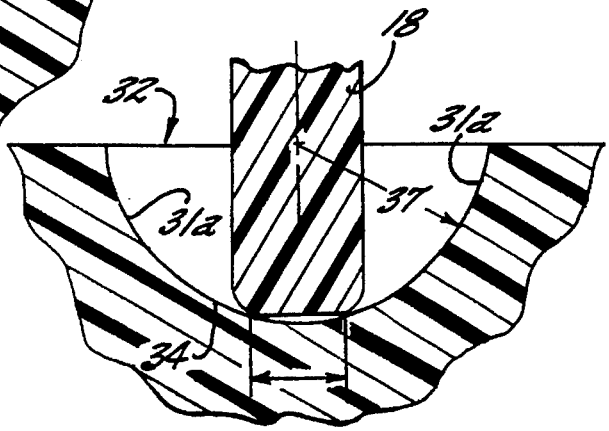
FIG. 4 is a fragmentary cross-sectional view of an annular groove of a plastic spacer ring of the present invention illustrating an annular groove having sidewalls substantially concave in transverse cross-section.

As shown in more detail in FIGS. 3 and 4, each of the annular grooves 16 is defined in transverse cross-section by opposed sidewalls 31 (FIG. 3) and 31*a* (FIG. 4) defining an open top 32 and a closed bottom 34. The width at the open top 32 is preferably substantially greater than the width at the closed bottom 34. More preferably the width at the open top 32 of each of the grooves 16 is greater than the predetermined wall thickness 20 of the plastic dye tube body 18 and the width at the closed bottom 34 of each of the annular grooves 32 is less than the predetermined wall thickness 20 of the plastic dye tube body 18. In addition it will be seen that the diameter of each groove 16 is substantially the same as the diameter of the dye tube 18 measured between the centers of the walls thereof.

Accordingly, the end face 22 of the plastic dye tube body 18 tangentially contacts each of the opposed sidewalls 31 (FIG. 3) and 31*a* (FIG. 4). This tangential contact along both an interior and an exterior surface of the end face 22 is substantially continuous about the circumference of the plastic dye tube body 18. This substantially continuous tangential contact along both an interior and exterior surface of the end face 22 of the plastic dye tube body 18 provides two seals to prevent pressurized dye from escaping between and around the plastic spacer rings 10 and the plastic dye tubes 18.

In the preferred embodiment, the predetermined wall thickness 20 of the plastic dye tube body 18 is within the range of between about 3.2 and about 3.8 millimeters. In addition, the diameter defined by the exterior of the walls of the of the plastic tube body 18 is between about 44.7 mm and about 67.5 mm. Accordingly, the diameter of the plastic tube body 18 from center to center of the walls of the tube body 18 is between about 43.0 mm and about 65.6 mm. As a result, the annular grooves 16 of the plastic spacer ring 10 of this preferred embodiment define a centerline 16*a* which has a diameter of between about 43.0 mm and about 65.6 mm, and a width across the open top 32 of each of the annular grooves 16 of substantially greater than about 3.8 millimeters and a width across the closed bottom 34 of each of the annular grooves 16 of less than about 3.2 millimeters in order to effectively provide a continuous tangential seal about the circumference about the interior and exterior surfaces of the plastic dye tube 18. Further, the substantially flat end faces 22 of the plastic dye tube bodies preferably have generally rounded corners to further improve its seal with the plastic spacer rings.

As shown in FIGS. 3 and 4, the geometry of the sidewalls 31 and 31*a* of the annular grooves 16 can be varied. Thus in the preferred embodiment shown in FIG. 3, the annular groove 16 is substantially V-shaped in transverse cross-section and includes substantially straight sidewalls 31. Preferably, in this embodiment the substantially V-shaped annular groove 16 illustrated in FIG. 3 comprises an interior angle 36 of between about 80 degrees and about 90 degrees.

In the advantageous embodiment illustrated in FIG. 4, the sidewalls 31*a* of the annular groove 16 are concave in transverse cross-section. In this embodiment, the radius 37 of the substantially semi-circular annular groove 16 illustrated in FIG. 4 is preferably between about 4.0 mm and about 4.5 mm.

It is preferred that the annular spacer ring have a wall thickness between its upper and lower surfaces 12 and 14, respectively, of at least about 14.0 mm. Preferably, the wall thickness of the spacer ring is between about 14.0 mm and about 16.0 mm. In addition, it is preferred that in all embodiments of the invention that the annular grooves in the spacer ring have a depth, from top to bottom, of at least about 3.0 mm. Preferably the depth of the annular grooves is between about 3.0 mm and about 4.0 mm.

In addition to sealing the end faces 22 of the plastic dye tubes 18, the plastic spacer rings 10 space and align the plastic dye tube bodies 18 with respect to spindle 26 of the package dyeing apparatus. This spacing and alignment is principally performed by the substantially concentric alignment of the annular grooves 16 with the bore 38 of the plastic spacer ring 10. As illustrated in FIG. 1, the inner diameter of bore 38 of the plastic spacer ring 10 is slightly larger than the exterior diameter of the spindle 26, thus, effectively axially aligning the plastic spacer ring 10 with spindle 26. Preferably the diameter of bore 38 is between about 5% greater than the diameter of the spindle.

Preferably, the plastic spacer ring 10 is formed of a plastic material which is structurally and chemically stable to dye at elevated temperatures. Thus, the plastic spacer ring 10 will absorb, and release, relatively little, if any, dye during the package dyeing process. In order to further ensure consistent dyeing of the yarn 24, the plastic spacer ring 10 and the plastic dye tube body 18 are preferably formed of materials which react in the same manner to the dyeing, scouring and drying cycles. To insure that the plastic spacer ring and the plastic dye tube body react in the same way to the dyeing, scouring and drying processing cycles, the plastic spacer ring and the plastic dye tube body may be formed of the same plastic material. In one preferred embodiment, the plastic spacer ring 10 is formed of a composite plastic material comprising polybutylene terephthalate and glass fibers in chopped form. In another preferred embodiment, the plastic spacer ring 10 is formed of nylon.

The invention has been described in considerable detail with reference to the preferred embodiments. However, as previously indicated, the invention is susceptible to numerous modifications, variations and substitutions without departure from the spirit and scope of the invention as described in the foregoing detailed description defined in the appended claims.

That which is claimed is:

1. A plastic spacer ring adapted for use with a plastic dye tube body of predetermined wall thickness and diameter defining opposed annular end faces and being structurally and chemically stable to dye at elevated temperatures comprising:

an annular body formed of a plastic material that is both structurally and chemically stable to dye at elevated temperatures having opposed upper and lower surfaces, each of said surfaces having an annular groove therein for receiving said end face of said plastic dye tube body, each of said grooves having a centerline of substantially the same diameter as the diameter from center to center of the wall of said plastic dye tube body and being defined in transverse cross-section by opposed side walls defining an open top and a closed bottom, wherein the width at the top of said groove is substantially greater than the wall thickness of said dye tube body and the width at the bottom of said groove is substantially less than the wall thickness of said dye tube body such that an annular void is defined between the bottom of said groove and the end face of the plastic dye tube, whereby the annular groove of the plastic spacer ring provides improved sealing with an end face of the plastic dye tube body due to separate tangential contact along both an interior surface and an exterior surface of the end face of the plastic dye tube body substantially continuously about the circumference of the plastic dye tube body.

2. The plastic spacer ring according to claim 1 wherein the diameter of each of said grooves is between about 43.0 mm and about 65.6.

3. The plastic spacer ring according to claim 2 wherein said width across the top of each of said grooves is substantially greater than about 3.8 mm and said width across the bottom of each of said grooves is less than about 3.2 mm.

4. The plastic spacer ring according to claim 1 wherein each of said grooves is substantially concentric with respect to a bore of said plastic spacer ring for spacing and aligning said plastic dye tube body with a spindle of a package dyeing apparatus.

5. The plastic spacer ring according to claim 1 wherein said plastic material is both structurally and chemically stable to dye at elevated temperatures.

6. The plastic spacer ring according to claim 5 wherein said plastic spacer ring is formed of a composite plastic material comprising polybutylene terephthalate and chopped glass fibers.

7. The plastic spacer ring according to claim 5 wherein said plastic spacer ring is formed of nylon.

8. The plastic spacer ring according to claim 5 wherein said plastic spacer ring and said plastic dye tube body are formed of materials that react in the same manner to dyeing, scouring and drying cycles.

9. The plastic spacer ring according to claim 8 wherein said plastic spacer ring and said plastic dye tube body are formed of the same plastic material.

10. The plastic spacer ring according to claim 9 wherein each of said sidewalls of each of said annular grooves is concave in transverse cross-section.

11. The plastic spacer ring according to claim 10 wherein said opposed sidewalls of each of said grooves are substantially V-shaped in transverse cross-section.

12. The spacer ring of claim 11 wherein the depth of each of said annular grooves is greater than about 3.0 mm.

13. In combination, a plastic dye tube body having a bodywall thickness between about 3.2 mm and about 3.8 mm and being structurally and chemically stable to dye at elevated temperatures and a plastic spacer ring for use in a yarn package dyeing process said spacer ring comprising:

an annular body formed of a plastic material that is both structurally and chemically stable to dye at elevated temperatures having opposed upper and lower surfaces, each of said surfaces having an annular groove therein for receiving an end face of said dye tube body, each of said grooves having a centerline diameter of between about 43.0 mm and about 65.6 mm and being defined in transverse cross-section by opposed side walls defining an open top and a closed bottom, wherein the width at the top of said groove is greater than about 3.8 mm and the width at the bottom of said groove less than about 3.2 mm, said dye tube body having a centerline diameter substantially the same as the centerline diameter of said annular groove, whereby the annular groove of the plastic spacer ring provides improved sealing with an end face of the plastic dye tube body such that an annular void is defined between the bottom of said groove and the end face of the plastic dye tube due to separate tangential contact along both an interior surface and an exterior surface of the end face of the plastic dye tube body substantially continuously about the circumference of the plastic dye tube body.

14. The plastic spacer ring according to claim 12 wherein each of said grooves is substantially concentric with respect to a bore of said plastic spacer ring for spacing and aligning said plastic dye tube body with a spindle of a package dyeing apparatus.

15. The plastic spacer ring according to claim 12 wherein said plastic material is both structurally and chemically stable to dye at elevated temperatures.

16. The plastic spacer ring according to claim 15 wherein said plastic spacer ring is formed of a composite plastic material comprising polybutylene terephthalate and chopped glass fibers.

17. The plastic spacer ring according to claim 15 wherein said plastic spacer ring is formed of nylon.

18. The plastic spacer ring according to claim 17 wherein each of said sidewalls of each of said annular grooves is concave in transverse cross-section.

19. The plastic spacer ring according to claim 18 wherein said opposed sidewalls of each of said grooves are substantially V-shaped in transverse cross-section.

* * * * *

UNITED STATES PATENT AND TRADEMARK OFFICE
CERTIFICATE OF CORRECTION

PATENT NO. : 5,461,889

DATED : October 31, 1995

INVENTOR(S) : Samuel F. Adams and Hans-Peter Bolz

It is certified that error appears in the above-identified patent and that said Letters Patent is hereby corrected as shown below:

ON THE COVER PAGE:

References Cited, U.S. Patent Documents, column 2, "Livingstone" should be -- Livingstone et al. --; "4,914,359" should be -- 4,919,359 --.

IN THE CLAIMS:

Column 8, claim 14, line 1, "12" should be -- 13 --.

Column 8, claim 15, line 6, "12" should be -- 13 --.

Signed and Sealed this

Twenty-third Day of January, 1996

*Attest:*

*Attesting Officer*

Bruce Lehman

BRUCE LEHMAN

*Commissioner of Patents and Trademarks*